United States Patent [19]

Johnston

[11] 4,227,269

[45] Oct. 14, 1980

[54] ADJUSTABLE BED

[75] Inventor: Bruce L. Johnston, Prairie Village, Kans.

[73] Assignee: Burke, Inc., Kansas City, Kans.

[21] Appl. No.: 938,950

[22] Filed: Sep. 1, 1978

[51] Int. Cl.[2] ..... A61G 7/14

[52] U.S. Cl. ..... 5/66; 5/68

[58] Field of Search ..... 5/60, 63, 66, 68, 69; 297/68

[56] References Cited

U.S. PATENT DOCUMENTS

| | | | |
|---|---|---|---|
| 3,216,026 | 11/1965 | Mann | 5/66 |
| 3,220,020 | 11/1965 | Nelson | 5/66 |
| 3,220,021 | 11/1965 | Nelson | 5/66 |
| 3,262,133 | 7/1966 | Beitzel | 5/66 |
| 3,278,952 | 10/1966 | Holm | 5/68 |
| 3,312,985 | 4/1967 | Callaghan | 5/66 |
| 3,336,606 | 8/1967 | Beitzel | 5/63 |
| 3,402,408 | 9/1968 | Hutt | 5/68 |
| 3,724,004 | 4/1973 | Behrens | 5/66 |
| 3,958,283 | 5/1976 | Adams et al. | 5/66 |
| 4,094,024 | 6/1978 | Benoit et al. | 5/66 |

*Primary Examiner*—Casmir A. Nunberg

*Attorney, Agent, or Firm*—Fishburn, Gold and Litman

[57] ABSTRACT

An adjustable bed is particularly adapted for the care of patients at home, and comprises a stationary frame, and a mattress support having a head section, a center section, and a foot section, which are hingedly interconnected. A lift arm has opposing ends thereof pivotally connected with the frame and the mattress support center section respectively, and includes a power device which selectively pivots the lift arm to raise and lower the mattress support thereby adjusting patient elevation. A longitudinally extending motor has opposing ends thereof pivotally connected with the frame and the mattress support center section at a point spaced from the lift arm center section pivot, whereby motor extension and retraction pivots the mattress support about the lift arm pivot, thereby bodily tilting the same for adjusting patient inclination.

7 Claims, 8 Drawing Figures

ADJUSTABLE BED

BACKGROUND OF THE INVENTION

This invention relates to adjustable beds, and in particular to an adjustable home care bed.

Beds for hospitals, nursing homes, and other similar health care facilities are typically adjustable between a plurality of positions and attitudes, such as the Fowler, the Trendelenburg, the sitting position, and the like, to facilitate patient care and comfort. Such institutional beds are typically expensive, heavy duty devices, which include a complicated adjustment mechanism. Further, institutional beds are generally constructed with an unusually high mattress elevation such that the patient can be attended and administered to by the doctors, nurses, orderlies, and the like, without requiring the attendant to bend or stoop over the patient. In such institutions, patient transport carts, operating tables, X-ray machines, and other similar equipment are also designed at this high elevation, such that the personnel working at the institution may easily attend to the patients and transport the same between the various pieces of equipment.

Care of invalid and non-ambulatory patients in the home has become increasingly popular in view of the rising costs of inpatient care administered in hospitals, nursing homes, and other health care institutions. It has been found that with proper care, minor ailments and/or lengthy recuperatory periods can be successfully attended to in the home, with professional care provided on an outpatient basis, at a substantial cost saving to the patient. One of the major problems involved in the home care of bedridden patients is that substantial physical strength is required to adjust the position of the patient, and to assist transportation of the patient between the bed and the wheel chair. This problem is particularly prevalent in the area of geriatrics, where elderly couples attempt to care for one another at home, and obtain professional assistance on an outpatient basis. Although some adjustable beds are provided with means to vertically adjust mattress height to facilitate patient transport, they are either quite complex and expensive, or do not have sufficient tilting functions for good patient care, and are therefore not practicable for home care use by the average patient.

SUMMARY OF THE INVENTION

The principal objects of the present invention are: to provide a simple and efficient adjustable bed for home care use; to provide such a bed which is sufficiently economical in manufacture that the same may be purchased by the average patient; to provide such a bed having means for adjusting the mattress in various positions and attitudes for patient comfort and treatment; to provide such a bed which is vertically adjustable to a raised position for patient treatment, and a lowered position for transport to a wheelchair; to provide such a bed having a mattress support with three hingedly interconnected sections, and means for pivoting each section with respect to the other for patient care and comfort; to provide such a bed having a lifting mechanism which is simple and dependable; to provide such a bed wherein the lifting mechanism is power driven and includes a self-locking mechanism to retain the patient in a preselected position; to provide such a bed having a control mechanism for preventing the mattress support from engaging the ground; and to provide such a bed which is economical to manufacture, efficient in use, capable of a long operating life, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims, and as a representative basis for teaching one skilled in the art to variously employ the present invention in virtually any appropriately detailed structure.

Figure 1:
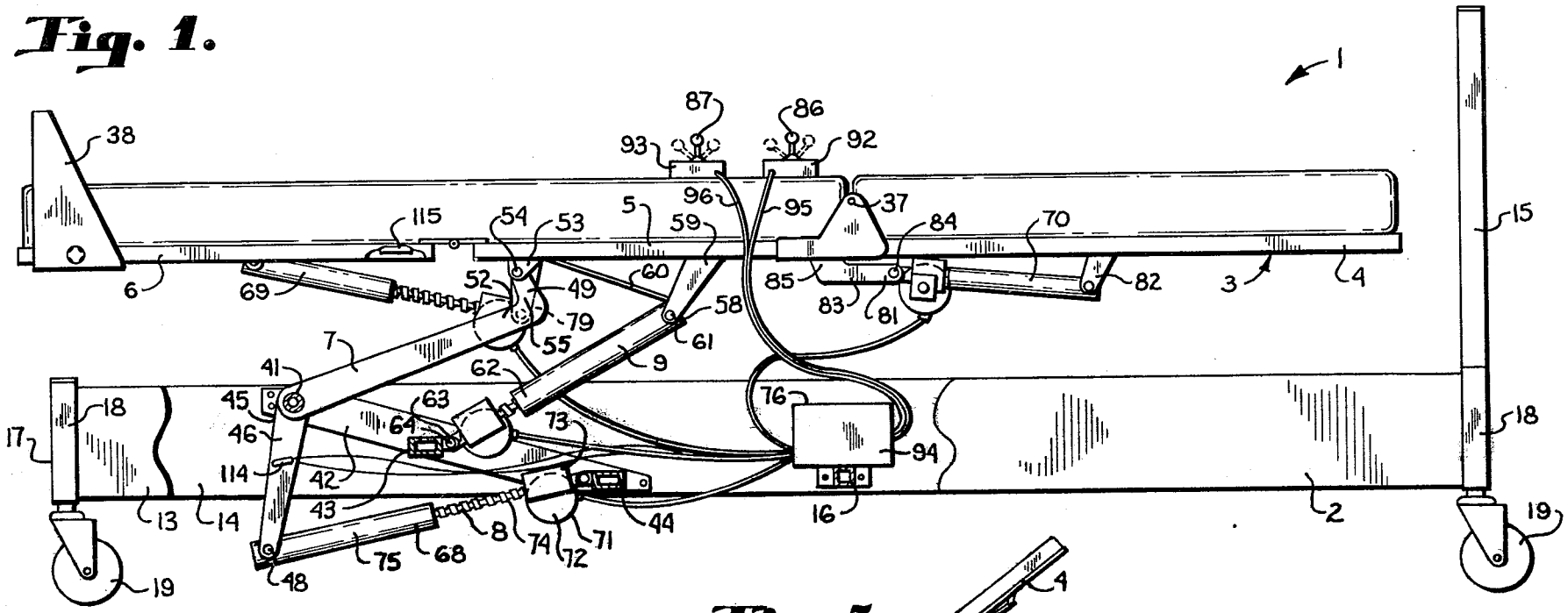
FIG. 1 is a side elevational view of an adjustable bed embodying the present invention, with portions thereof broken away to reveal internal construction.
Figure 2:
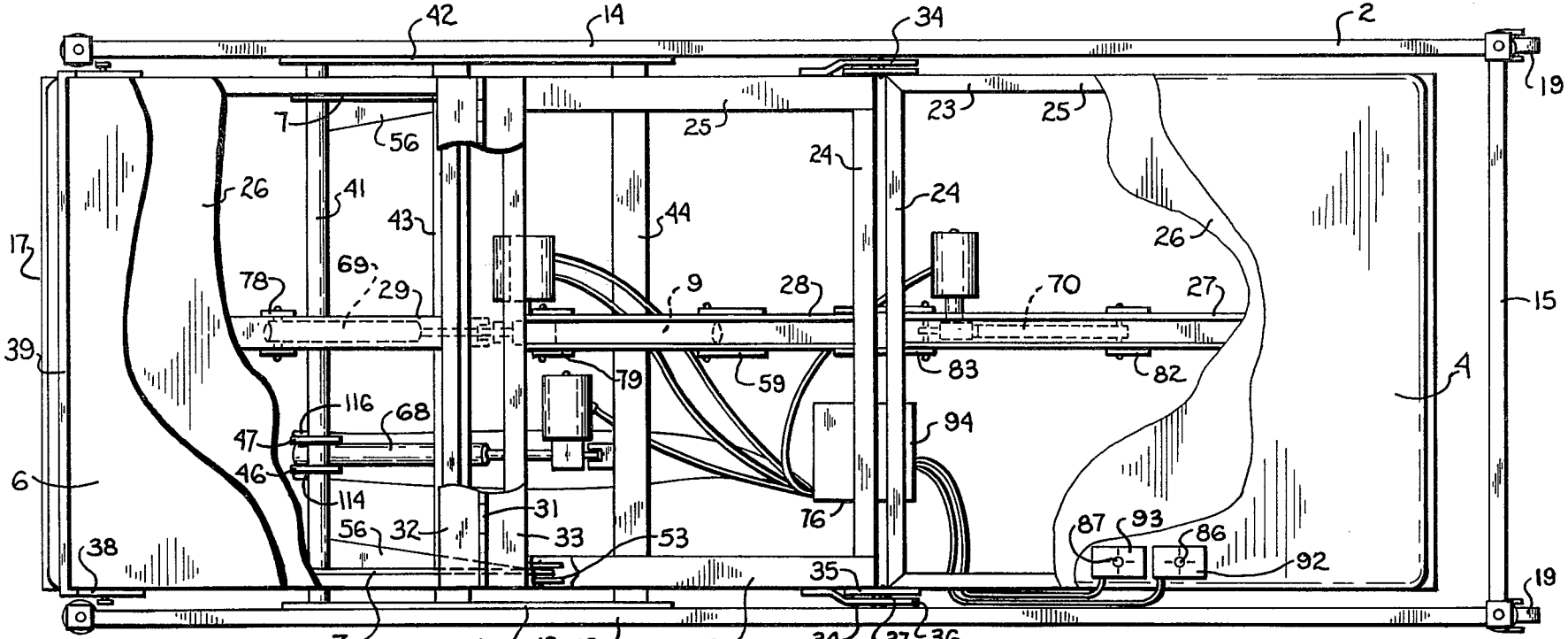
FIG. 2 is a top elevational view of the bed, with portions thereof broken away.
Figure 3:
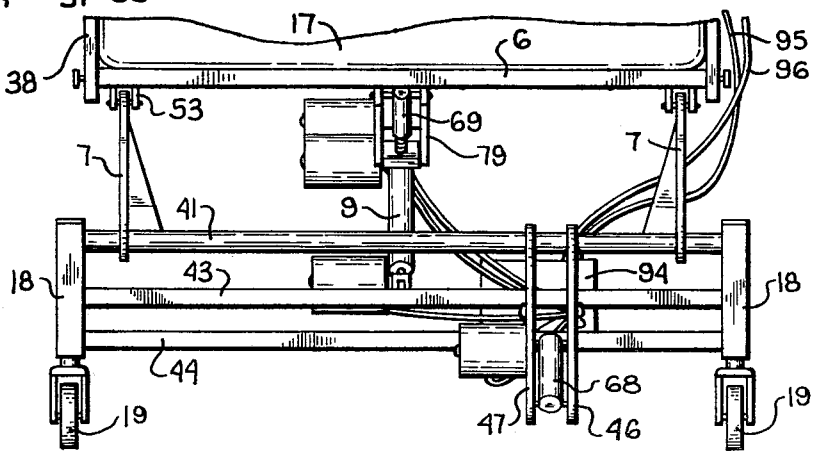
FIG. 3 is a fragmentary end elevational view of bed.

For purposes of description herein, the terms "upper", "lower", "right", "left", "rear", "front", "vertical", "horizontal", and derivatives thereof, shall relate to the invention as oriented in FIGS. 1 and 2, however, it is to be understood that the invention may assume various alternative orientations, except where expressly specified to the contrary.

The reference numeral 1 generally designates an adjustable bed which is particularly adapted for home care use, and comprises a stationary frame 2, and a mattress support 3, having a head section 4, a center section 5, and a foot section 6 pivotally interconnected. A lift arm 7 has opposing ends thereof pivotally connected with the frame 2 and the mattress support center section 5 respectively, and includes a power device 8 which selectively pivots the lift arm 7 to raise and lower the mattress support 3 to adjust patient elevation. A longitudinally extending motor 9 has opposing ends thereof pivotally connecting with the frame 2 and the center section 5 at a point spaced from the lift arm center section pivot, whereby motor extension and retraction pivots the mattress support with respect to the lift arm 7 thereby bodily tilting the mattress support and adjusting patient inclination.

The frame 2 is a stationary, ground engaging structure which is adapted to support the patient and the mattress support above the ground. In the illustrated structure, the frame 2 includes a pair of parallel, longitudinally extending side rails 13 and 14 which are interconnected at the head of the frame by a laterally positioned headboard 15. The headboard 15 extends upwardly from the bed side rails past the upper surface of the mattress to a preselected height which is substantially commensurate with that of conventional beds. An intermediate brace 16 interconnects the side rails 13 and 14 at a medial portion thereof, and the foot end 17 of the bed is open to allow the mattress support 3 to pass therethrough. The frame 2 is rigid, and includes vertically oriented legs 18 attached to the opposing ends of each of the side rails 13 and 14. In the illustrated structure, the legs are not vertically adjustable, and are provided with depending casters 19 to facilitate movement of the bed.

As best illustrated in FIG. 2, each of the sections 4–6 of the mattress support 3 has a generally rectangular shape, and includes a rigid, peripheral frame 23 with interconnected end and side members 24 and 25. The illustrated end and side members 24 and 25 have an L-shaped cross section with one web oriented laterally across the mattress support, and the other web directed downwardly. A flat plate or sheet 26 overlies each of the support frames 23, and is fixedly attached thereto by suitable fasteners, and preferably by means which will not interfere with the comfort of the bed, such as welds (not shown) intermittently disposed along the frame 23 on the interior side of the sheet 26. Each of the mattress sections 4–6 also includes a brace member 27–29 respectively, extending between the ends 24 of the respective frames, and positioned centrally therebetween. In this example, each of the braces 27–29 is a C-shaped channel having the ends and sides thereof welded to the frame ends 24 and the lower surface of the cover sheet 26. The free edges of the head and center braces 27 and 28 are oriented upwardly, abutting the sheet 26, and the webs of the foot brace are directed downwardly away from the sheet 26.

Figure 5:
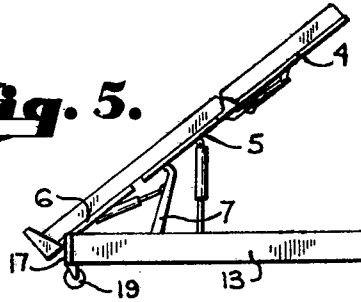
FIG. 5 is a partially schematic, side elevational view of the bed, shown in a fully tilted position.

The adjacent frame end edges of the foot and center sections 4 and 5 are pivotally interconnected by a piano hinge 31 which extends substantially across the mattress support sections and has opposing plate portions 32 and 33 attached to the upper surface of the foot section 6 and center section 5 respectively. The adjacent end edges of the head section 4 and center section 5 are interconnected by a pair of pivot hinges 34 having an interior plate 35 attached to the side edge of the head section 4, and an exterior plate 36 attached to the side edge of the center section 5. The exterior plate 35 includes an offset arm portion, whereby the interior and exterior hinge plates 35 and 36 mate in a parallel fashion, and a pin 37 extends horizontally therethrough and pivotally interconnects the same. In this example, an adjustable foot support 38 is mounted on the foot section 6 adjacent the free end thereof, and includes a transversely extending plate 39 which abuts the feet of the user and retains the patient on the bed when the same is in a forwardly inclined position, such as illustrated in FIG. 5.

The lift arm 7 and the longitudinally extending motor 9 interconnect the mattress support 3 with the stationary frame 2, and provide means for elevating and tilting the mattress support with respect to the frame. In the illustrated example, the adjustable bed includes two lift arms 7 positioned opposingly on the interior side of the side rails 13 and 14 a predetermined distance from the foot end 17 of the frame. A shaft 41 is rotatably mounted in the frame, extends transversely thereacross, and has the lowered ends of the lift arms 7 fixedly attached thereto for rotation with the shaft. The illustrated structure includes a pair of rigid support plates 42 which are mounted on the interior sides of each of the side rails to provide additional support thereto and means for pivotally interconnecting the shaft ends with respect to the side rails. A pair of laterally extending braces 43 and 44 extend between and are attached to the plates 42 for purposes to be described hereinafter. To facilitate rotation of the shaft 41 and arms 7, bracket 45 is attached to the shaft 41 at a medial portion thereof, and includes a pair of spaced apart arms 46 and 47 which are adapted to pivotally mount one end of the longitudinally extending motor 68 therein. The free ends 48 of the arms 46 and 47 are generally downwardly oriented, and rotate with the shaft 41, whereby retraction of the drive motor 68 pulls the arm free ends 48 toward the head portion of the bed, thereby rotating the shaft 41 and the lift arm 7 in a counterclockwise direction as viewed in FIG. 1, and elevating the mattress support 3. The upper end 52 of each of the lift arms 7 includes an angled extension 49 positioned substantially normally to the body of the arm. The free ends of the extensions 49 are pivotally attached to the lower surface of the center section by U-shaped brackets 53 and hinge pins 54. The purpose of the perpendicular extension 55 is to provide proper clearance between the mattress support and the frame. The brackets 53 are positioned adjacent opposing side edges of the center section 5 and thereby provide lateral stability to the bed. Each of the illustrated lift arms 7 includes a triangularly shaped gusset or brace 56 mounted on the interior side thereof for additional strength. The lift arm arrangement 7 for elevating the mattress support is arranged in a manner such that as the mattress support is elevated, it also translates toward the foot of the bed and vice versa. Because the foot portion 17 of the bed is open, the foot section 6 of the mattress support is allowed to pass therethrough without interference.

The longitudinally extending motor 9 has the upper end 58 thereof pivotally attached to a bracket 59 which is connected with the center section 5 and depends therefrom. As shown, the bracket 59 has a U-shape, with the upper ends of parallel arms rigidly fixed on opposing sides of the brace 28 and the lower ends extending downwardly on opposing sides of the motor 9. The arms are canted or angled slightly toward the foot end of the bed, and includes an angle brace 60 to provide additional rigidity. The upper motor end is connected in the bracket 59 at an interconnecting pin or hinge 61, which is spaced apart from the lift arm hinge 54 to provide secure longitudinal mounting for the mattress support. The lower end 62 of the longitudinally extending motor 9 is pivotally connected to the lateral brace 43 by a U-shaped bracket 63 and pin 64. The hinge 64 is spaced apart from the shaft 41 for securely supporting the mattress support.

The illustrated bed includes four longitudinally extending motors 9, 68, 69 and 70, which are interconnected with the various parts of the bed to control the elevation and inclination of the mattress support, as well as the mutual positioning of the various mattress sections. Preferably, each of the motors includes means which automatically and positively locks the motor in place upon motor deactivation to retain the mattress support in the selected position. The illustrated motors are of the ball and screw type, and include a rotary electric motor 71 operable in either rotational direction, and having an outer housing 72 and a power transmission portion 73. One end of a helically shaped screw 74 is mounted in the transmission 73 and is operably connected therewith, whereby activation of the electric motor 71 rotates the screw 74. The other end of the screw 74 is threadedly connected in an elongate sleeve member 75 having a plurality of anti-friction balls mounted on the interior portion thereof which engage the root of the screw thread 74 for smooth, secure engagement therewith. Rotation of the screw 74 in one direction pulls the sleeve 75 convergingly toward the motor, and rotation of the screw in the opposite direction pushes the sleeve divergingly apart from the motor. A pin (not shown) is mounted laterally in the screw adjacent the motor housing, and engages the sleeve to form a retract stop. The sleeves are mounted on the screws in such a manner that when a sleeve reaches its extreme position, a clutching action allows the screw to free wheel in the sleeve. Each of the motors includes an electrical conductor connected with a remote control 76 for selectively and individually operating each of the various motors.

The elevation or high-low ball and screw motor 68 has the free end of the sleeve 75 pivotally mounted between the arms 46 and 47 of the bracket 45, whereby in the attitude illustrated in FIG. 1, motor rotation which retracts the sleeve 68 pivots the arms 46 and lifts arms 7 with the shaft 41 in a counterclockwise direction, thereby elevating the mattress support. Motor rotation which extends the sleeve of the elevation ball and screw motor 68 rotates the arms 46, the lift arms 7 and the shaft 41 in a clockwise direction, thereby lowering the mattress support. The lift arms 7 and the motor 9 are arranged in a parallelogram shape, such that rotation of the lift arms 7 causes the motor 9 to rotate about the hinge 64 in a similar manner, thereby maintaining the level position of the mattress support.

The free end of the sleeve of the tilt ball and screw motor 9 is pivotally mounted between the depending arms of the bracket 59 at the hinge 61. The housing portion of the motor is pivotally attached to the brace 43 by a hinge pin 64, thereby allowing the motor 9 to rotate about the hinge pin during elevation of the mattress support. Extension of the ball and screw motor 9 causes the mattress support center section 5 to rotate about the pivot hinge 53, whereby the head section 4 of the mattress support, when held stationary with the center section 5, moves upwardly. In contrast, retraction of the ball and screw motor 9 pivots the mattress support center section in a manner which causes the head section to move downwardly. The lift arms 7 and the tilt motor 9 are arranged in a parallelogram relationship, with the distance between hinges 41 and 63, and 54 and 61 being substantially equal, and lying along parallel lines when the tilt is adjusted to a level mattress position.

The foot ball and screw motor 69 has the sleeve portion thereof pivotally attached to a bracket 78, which is in turn attached to the lower side of the foot section 6 on opposing sides of the brace 29. The housing portion of the motor is pivotally attached to a bracket 79 which is attached to and depends from a rearward portion of the center section 5. Extension of the foot motor 69 causes the foot section 6 to pivot about the hinge 31 in an upwardly manner. Conversely, retraction of the ball and screw motor 69 causes the foot section to pivot downwardly.

The head ball and screw motor 70 is connected between the head section 4 and center section 5, and the sleeve portion thereof is pivotally attached to a bracket member 82 mounted on the head section 4. The housing portion of the motor is pivotally attached to a bracket 83 at a hinge 84. Extension of the motor causes the head section 4 to pivot about the hinge 84 in an upwardly direction. Retraction of the motor causes the head section 4 to rotate downwardly with respect to the center section 5 to raise and lower the patient's head. The illustrated bracket 83 includes a forwardly angled base portion 85, and forwardly extending arms 81 which position the hinge 84 a spaced apart distance forwardly of the hinge 37 which interconnects the head and center sections of the mattress support. In this manner, the head section 4 may be pivoted with respect to the center section 5 without interference with the mattress support.

Figure 8:
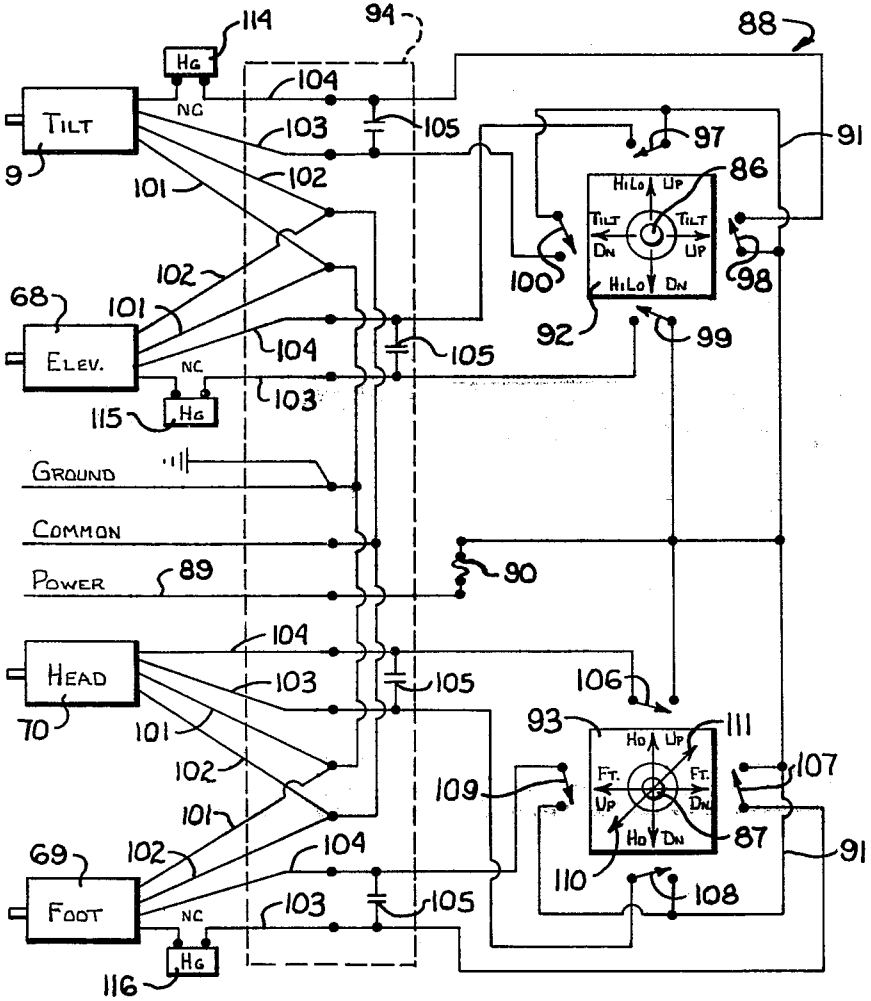
FIG. 8 is an electrical diagram of a controlling circuit and switches for said bed.

Each of the motors 9 and 68–70 inclusive is electrically connected with a switch and circuit arrangement 88 for selectively activating each of the motors and controlling the direction of rotation thereof. As best illustrated in FIG. 8, the circuit 88 includes an incoming power line 89, preferably connected with common household current of 110 Volts, A.C., at 60 Hertz. The power line 89 includes a fuse 90 for overload protection, and is connected to the power side 91 of two multi-position switches 92 and 93 respectively. In this example, the switches are of the joy stick type, such that they may be bumped or otherwise manipulated by persons having impaired or limited use of their arms and hands. Each of the switches 92 and 93 includes an upstanding lever or controller 86 and 87 respectively, with a spring mechanism which automatically returns the same to a central, open position. A rigid junction box 94 is mounted to the center brace 16 along a medial portion thereof, and houses the control circuit. The switches 92 and 93 are connected with the circuit in the junction box by a pair of electrical cables 95 and 96 respectively, which are flexible, and elongate, thereby allowing the switches to be positioned remote from the junction box 94, such as on the surface of the bed mattress, for operation by the patient.

The illustrated switch 92 includes four positions and four corresponding switch members 97–100 respectively, and is connected with the tilt motor 9 and the elevation motor 68. Each of the motors 9, and 68–70 includes four conductors, comprising a ground 101, a common 102, and two power lines 103 and 104 connected with opposite ends of the motor winding to control the direction of motor rotation. A condenser 105 is connected between each pair of motor conductors 103–104, to facilitate motor starting, and is mounted in the junction box 94. The ground and common conductors 101 and 102 are respectively interconnected with the ground and common conductors of the other motors. The tilt motor conductors 103 and 104 are respectively connected with the switch members 100 and 98 respectively on switch 92. As viewed in FIG. 8, manipulation of the switch controller 86 in the right-hand direction closes the switch 98 and activates the tilt motor in a direction which extends the motor to tilt the bed upwardly. Manipulation of the controller in the left-hand direction closes the switch 100, thereby activating the motor in the opposite direction, to retract the motor and tilt the bed downwardly. Movement of the controller 86 in an upwardly direction closes the switch 97, and activates the elevation motor to retract the same and move the bed upwardly. Manipulation of the controller in a downwardly direction causes the switch 99 to close, thereby activating the motor in the reverse direction and lowering the mattress support 3.

Figure 7:
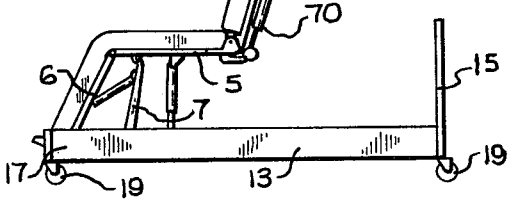
FIG. 7 is a partially schematic, side elevational view of the bed in a sitting position.
Figure 6:
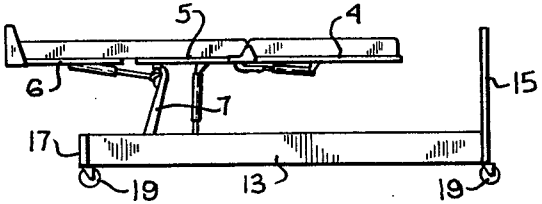
FIG. 6 is a partially schematic, side elevational view of the bed in a fully raised position.

The second switch 93 includes four switches 106–109 respectively. The conductors 103 and 104 of the head motor 70 are respectively connected with the switches 106 and 108. The conductors 103 and 104 of the foot motor 69 are connected with the switch members 107 and 109 respectively. Manipulation of the controller 87 in the upward position (as viewed in FIG. 8) closes the switch 106, causes the head motor 70 to extend, thereby rotating the head section 4 upwardly with respect to the center section 5. Movement of the controller downwardly closes the switch 108, thereby retracting the head motor 70, and causing the center section 4 to rotate downwardly. Movement of the controller 87 in the left-hand direction closes switch 109, and activates the foot motor 69 in a direction which causes the same to extend, thereby rotating the foot section 6 upwardly with respect to the center section 5. Movement of the controller to the right-hand side of the switch closes switch member 107 and activates the foot motor in the opposite direction, thereby retracting the same, and pivoting the foot section 6 downwardly. The controller switch 93 includes two additional positions 110 and 111 which are oriented diagonally on the switch, and are adapted to quickly move the bed to and from the sitting position. Movement of the controller to the diagonal position 111, simultaneously closes both switches 106 and 107, thereby activating the head motor 70 to raise the same to the fully raised position, and the foot motor 69 to the fully lowered position (FIG. 7). Movement of the controller to the oppositely oriented position 110 simultaneously activates both the motors 69 and 70 in the reverse direction to move the bed from the sitting position to a flat or level position (FIG. 6).

Control means are connected with the circuit 88 to prevent the mattress support from inadvertently engaging the ground or floor. The control means comprises level sensing switches, such as the three illustrated mercury switches 114—116, which are connected with various portions of the bed to detect the relative orientation thereof. The mercury switch 114 is connected in the conductor 104 of the tilt motor 9, and is physically mounted on the high-low arm member 46. The switch is positioned on the arm member 46 in such a manner that the tilt motor 9 will not move the bed upwardly into a tilt position unless the foot section 6 will clear the floor. In a similar manner, mercury switch 116 is connected in the foot motor conductor 103, and is physically mounted on the other high-low arm member 47 with such an orientation that the foot motor will not operate if the full retraction of the foot motor 69 will cause the end of the foot section 6 to engage the floor. The mercury switch 115 is connected in the conductor 103 of the elevation motor 68 and is mounted between the webs of the brace 29 on the foot section 6. The switch 115 is oriented in such a manner that the elevation motor 68 will not extend to lower the bed if the foot section 6 is in a non-level position, whereby bed retraction would cause engagement of the foot section with the floor.

Figure 4:
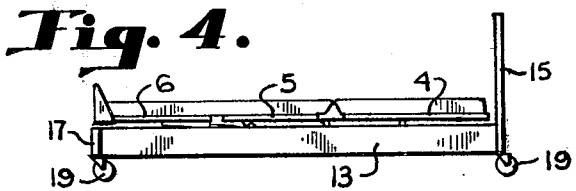
FIG. 4 is a partially schematic, side elevational view of the bed shown in a fully lowered position.

In use, the adjustable bed may be manipulated by the patient himself or by an attendant, to position the patient in a wide variety of desired positions. As illustrated in FIG. 4, the mattress support 3 is retractable to a fully lowered position, wherein the top surface 118 of the mattress 119 has a height above the ground which is substantially commensurate with a wheelchair seat (not shown) to facilitate transportation of the patient therebetween. Manipulation of the control switch 93 upwardly (as viewed in FIG. 8) to close switch member 106, causes the elevation motor 68 to retract, thereby pivoting the lift arms 7 into a fully raised position as illustrated in FIG. 6. As the lift arms 7 rotate to their fully raised position, the motor 9 similarly pivots about hinge point 63 to a substantially vertical orientation. In the fully raised position, the patient may be easily attended to and cared for without requiring the attendant to stoop over the bed. Manipulation of the switch 92 in the left and right-hand directions selectively closes the switches 98 and 100 thereby causing the motor 9 to extend and retract and tilt the mattress support upwardly and downwardly about pivot point 54. To obtain a sitting position, as illustrated in FIG. 7, the operator manipulates the center section 5 into a substantially horizontal position, positions the head section 4 in a fully upward position, and the foot section 6 in a fully downward position. Manipulation of switch controller 87 to the diagonal position 111 automatically and simultaneously activates the foot and head motors to accomplish the sitting position. In this orientation, the lower portion of the foot section 6 extends through the open end of the bed 17. The switches 92 and 93 may be similarly manipulated to operate the four motors 9 and 68–70 to obtain a wide variety of bed positions and bed contours.

It is to be understood that while I have illustrated and described certain forms of my invention, it is not to be limited to the specific forms or arrangement of parts herein described and shown.

What I claim and desire to secure by Letters Patent is:

1. An adjustable bed comprising:

(a) a ground engaging, stationary frame;

(b) a mattress support having a center portion;

(c) an arm having one end thereof pivotally connected with said frame at a first pivot and the other end thereof pivotally connected with said center portion at a second pivot;

(d) means selectively rotating said arm about said first pivot for raising and lowering said mattress support and adjusting patient height;

(e) a longitudinally extending motor having one end thereof pivotally connected with said frame and the other end thereof pivotally connected with said center portion at a point spaced apart from said second pivot, whereby motor extension and retraction pivots said center section about said second pivot and tilts said mattress support for adjusting patient inclination;

(f) said mattress support includes a head section, a center section, and a foot section, each being pivotally interconnected;

(g) said other end of said arm and said motor each being connected with said center section; and including (h) means pivoting said head section with respect to said center section;

(i) means pivoting said foot section with respect to said center section;

(j) said longitudinally extending motor, said arm rotating means, said head section providing means, and said foot section pivoting means each includes an electric ball-and-screw motor;

(k) control means connected with said longitudinally extending motor, said arm rotation means, and said foot section pivoting means for preventing said mattress support foot section from being pivoted thereby into engagement with the ground;

(l) said longitudinally extending motor includes a first power conductor activating the same for upward tilting of said mattress support;

(m) said arm rotation means includes a second power conductor activating the same for downward elevation of said mattress support;

(n) said foot section pivoting means includes a third power conductor activating the same for downward pivoting of said foot section with respect to said center section;

(o) said control means comprises:

(1) first and second level sensing switches electrically connected in said first and second power conductors respectively, and each being mounted on said bed for rotation with raising and lowering of the bed;

(2) a third level sensing switch electrically connected in said third power conductor and mounted on said foot section for movement therewith; and (3) said first, second and third level sensing switches being oriented on said bed for deactivating an associated one of said ball-and-screw motors for preventing inadvertent engagement of the foot section with the ground or the stationary frame.

2. An adjustable bed comprising:

(a) a ground engaging, stationary frame;

(b) a mattress support having a center portion;

(c) an arm having one end thereof pivotally connected with said frame at a first pivot and the other end thereof pivotally connected with said center portion at a second pivot;

(d) means selectively rotating said arm about said first pivot for raising and lowering said mattress support and adjusting patient height;

(e) a longitudinally extending motor having one end thereof pivotally connected with said frame and the other end thereof pivotally connected with said center portion at a point spaced apart from said second pivot, whereby motor extension and retraction pivots said center section about said second pivot and tilts said mattress support for adjusting patient inclination;

(f) said arm comprises first and second lift arms positioned on opposing sides of said frame; each of said lift arms having an upper end thereof pivotally connected with said center section at a point spaced apart from said second pivot for transverse stability; and including (1) a shaft rotatably mounted in said frame, extending transversely thereacross, and fixedly interconnecting said lift arms in an aligned orientation for rotation with said shaft; and (g) said arm rotating means comprises a longitudinally extending ball-and-screw motor having first and second ends; and including (1) a motor arm fixedly attached to said shaft and having a free end thereof positioned a spaced apart distance therefrom; said ball-and-screw motor first and second ends being pivotally connected with said motor arm free end and said stationary frame respectively, whereby extension and retraction of said ball-and-screw motor pivots said shaft and said lift arms to lower and raise said mattress support.

3. An adjustable bed as set forth in claim 2 including:

(a) means automatically and positively locking said motor in place upon motor deactivation for retaining said mattress support in a selected position.

4. An adjustable bed as set forth in claim 2 including:

(a) a mattress positioned on said mattress support, and having an upper surface; and wherein (b) said frame is positioned closely adjacent to the ground; and (c) said mattress support is retractable to a fully lowered position, wherein said mattress top surface has a height above the ground which is substantially commensurate with a wheel chair seat to facilitate patient transportation therebetween.

5. An adjustable bed as set forth in claim 4 wherein:

(a) said frame includes an open foot end and allows said foot section to pass therethrough.

6. An adjustable bed comprising:

(a) a ground engaging, stationary frame;

(b) a mattress support having a center portion;

(c) an arm having one end thereof pivotally connected with said frame at a first pivot and the other end thereof pivotally connected with said center portion at a second pivot;

(d) a longitudinally extending motor having one end thereof pivotally connected with said frame and the other end thereof pivotally connected with said center portion at a point spaced apart from said second pivot;

(e) said motor one end being connected with said frame at a third pivot, and said motor other end being connected with said center portion at a fourth pivot;

(f) said first and third pivots are spaced apart a distance substantially equal to the distance between said second and fourth pivots, and lie along substantially parallel lines therewith when said mattress support is in a level position thereby assuming a parallelogram shaped arrangement;

(g) means selectively rotating said arm about said first pivot and cooperating with the pivotal mounting of said motor for raising and lowering said mattress support and adjusting patient height and maintaining same in a level position;

(h) said motor extension and retraction pivots said center section about said second pivot and tilts said mattress support for adjusting patient inclination;

(i) said mattress support includes said center section, and a head section and a foot section pivotally interconnected to said center section;

(j) motor means operatively connected to the center section and head section for pivoting the head section with respect to the center section;

(k) motor means operatively connected to the center section and foot section for pivoting the foot section with respect to said center section; and (l) said longitudinally extending motor, said arm rotating means, said head section pivoting means and said foot section pivoting means each including a respective electric sleeve-and-screw motor operating independently of the others.

7. An apparatus as set forth in claim 6 wherein said longitudinally extending motor and motor means includes:

(a) an electric rotary motor pivotally connected with one section;

(b) a screw connected with and driven by said rotary motor; and (c) a sleeve pivotally connected to an other section and threadedly mounted on said screw for selective translation thereon in response to rotary motor activation.

* * * * *